US009276306B2

(12) United States Patent
Clayton et al.

(10) Patent No.: US 9,276,306 B2
(45) Date of Patent: Mar. 1, 2016

(54) AUTOMATICALLY DEPLOYABLE COMMUNICATIONS SYSTEM

(71) Applicant: GATR Technologies, Inc., Huntsville, AL (US)

(72) Inventors: William R. Clayton, Huntsville, AL (US); Paul A. Gierow, Madison, AL (US)

(73) Assignee: GATR Technologies, Inc., Huntsville, AL (US)

( * ) Notice: Subject to any disclaimer, the term of this patent is extended or adjusted under 35 U.S.C. 154(b) by 338 days.

(21) Appl. No.: 13/836,801

(22) Filed: Mar. 15, 2013

(65) Prior Publication Data

US 2014/0266970 A1 Sep. 18, 2014

(51) Int. Cl.

| | |
|---|---|
| ***H01Q 1/08*** | (2006.01) |
| ***H01Q 1/12*** | (2006.01) |
| ***H01Q 1/14*** | (2006.01) |
| ***H01Q 3/08*** | (2006.01) |
| ***H01Q 15/16*** | (2006.01) |
| ***H01Q 19/13*** | (2006.01) |

(52) U.S. Cl.

CPC ..... *H01Q 1/082* (2013.01); *H01Q 1/08* (2013.01); *H01Q 1/081* (2013.01); *H01Q 1/125* (2013.01); *H01Q 1/1235* (2013.01); *H01Q 1/14* (2013.01); *H01Q 3/08* (2013.01); *H01Q 15/163* (2013.01); *H01Q 19/13* (2013.01)

(58) Field of Classification Search

CPC ..... H01Q 1/08; H01Q 1/081; H01Q 1/082; H01Q 1/125

USPC ..... 343/705, 706, 872, 878, 880, 881

See application file for complete search history.

(56) References Cited

U.S. PATENT DOCUMENTS

| | | | | | |
|---|---|---|---|---|---|
| 2,814,038 | A | * | 11/1957 | Miller | 343/757 |
| 2,913,726 | A | * | 11/1959 | Currie et al. | 343/872 |
| 4,360,182 | A | * | 11/1982 | Titus | 248/371 |
| 4,672,389 | A | | 6/1987 | Ulry | |
| 4,771,293 | A | * | 9/1988 | Williams et al. | 343/757 |
| 4,815,757 | A | * | 3/1989 | Hamilton | 280/764.1 |
| 5,166,696 | A | * | 11/1992 | Rupp et al. | 343/711 |
| 6,163,682 | A | | 12/2000 | Lee | |
| 6,963,315 | B2 | * | 11/2005 | Gierow et al. | 343/872 |

(Continued)

FOREIGN PATENT DOCUMENTS

EP 1596464 A1 11/2005

OTHER PUBLICATIONS

Freeland, R. E. et al.; Development of Flight Hardware for a Large, Inflatable-Deployable Antenna Experiment, Jet Propulsion Laboratory, Pasadena, California, 2014; http://web.archive.org/web/20100527080026/http://trs-new.jpl.nasa.gov/dspace/bitstream/2014/30363/1/95/0953.pdf.

*Primary Examiner* — Dameon E Levi
*Assistant Examiner* — Jennifer F Hu
(74) *Attorney, Agent, or Firm* — Lanier Ford Shaver & Payne, P.C.; Ann I. Dennen

(57) ABSTRACT

An automatically deployable, portable communications system includes an inflatable antenna stored in a case that also houses the antenna support assembly, drive mechanisms, inflation control modules, power supply modules and a control system. The case also includes a switch configured to close a circuit with the power supply module and initiate deployment and operation of the antenna when the case lid is opened.

12 Claims, 11 Drawing Sheets

(56) References Cited

U.S. PATENT DOCUMENTS

| | | | | |
|---|---|---|---|---|
| 7,598,916 | B2 * | 10/2009 | Inbal et al. | 343/718 |
| 7,679,573 | B2 * | 3/2010 | Shuster et al. | 343/766 |
| 7,764,243 | B2 * | 7/2010 | Gierow et al. | 343/766 |
| 7,859,475 | B2 * | 12/2010 | Gierow et al. | 343/766 |
| 8,021,122 | B2 * | 9/2011 | Clayton et al. | 417/2 |
| 8,319,696 | B2 * | 11/2012 | Clayton et al. | 343/765 |
| 8,599,097 | B2 * | 12/2013 | Intravatola | 343/881 |
| 8,988,307 | B2 * | 3/2015 | Carley et al. | 343/880 |
| 2002/0093460 | A1 * | 7/2002 | Alexeff et al. | 343/901 |
| 2003/0160733 | A1 * | 8/2003 | Lee et al. | 343/912 |
| 2004/0222938 | A1 * | 11/2004 | Gierow et al. | 343/872 |
| 2006/0071872 | A1 * | 4/2006 | Gierow et al. | 343/872 |
| 2006/0082510 | A1 * | 4/2006 | Eckstein et al. | 343/720 |
| 2006/0284775 | A1 | 12/2006 | Kaplan et al. | |
| 2008/0042921 | A1 * | 2/2008 | Gierow et al. | 343/882 |
| 2008/0113676 | A1 | 5/2008 | Hutton et al. | |
| 2009/0002257 | A1 * | 1/2009 | de Jong et al. | 343/872 |
| 2009/0158878 | A1 * | 6/2009 | Clayton et al. | 74/479.01 |
| 2009/0243955 | A1 * | 10/2009 | Legare et al. | 343/882 |
| 2010/0018595 | A1 * | 1/2010 | Clayton et al. | 137/565.13 |
| 2010/0277384 | A1 * | 11/2010 | Gierow et al. | 343/766 |
| 2014/0266969 | A1 * | 9/2014 | Clayton et al. | 343/878 |

* cited by examiner

AUTOMATICALLY DEPLOYABLE COMMUNICATIONS SYSTEM

BACKGROUND

1. Field

The present invention relates generally to communications systems, and, particularly, to communications systems including inflatable antennas, and, more particularly, to automatically deployable communications systems including inflatable antennas.

2. Description of the Problem and Related Art

Inflatable antennas have shown advantages over their more rigid counterparts in that inflatable version are light weight and more portable. One such inflatable antenna was disclosed in U.S. Pat. No. 6,963,315, to Gierow, et al. These inflatable antennas have demonstrated particularly responsive to shortcomings found in the prior art relating to rapid deployment and ease of operation, especially in remote areas and emergency scenarios, for example, after a natural disaster occurs.

To improve upon the numerous benefits of inflatable antennas, the present disclosure provides a self-contained system, housed in a portable case, which allows automatic deployment of the antenna with little-to-no user action necessary.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION

The various embodiments of the present invention and their advantages are best understood by referring to FIGS. 1 through 18B of the drawings. The elements of the drawings are not necessarily to scale, emphasis instead being placed upon clearly illustrating the principles of the invention. Throughout the drawings, like numerals are used for like and corresponding parts of the various drawings.

Furthermore, reference in the specification to "an embodiment," "one embodiment," "various embodiments," or any variant thereof means that a particular feature or aspect of the invention described in conjunction with the particular embodiment is included in at least one embodiment of the present invention. Thus, the appearance of the phrases "in one embodiment," "in another embodiment," or variations thereof in various places throughout the specification are not necessarily all referring to its respective embodiment.

Figure 1:
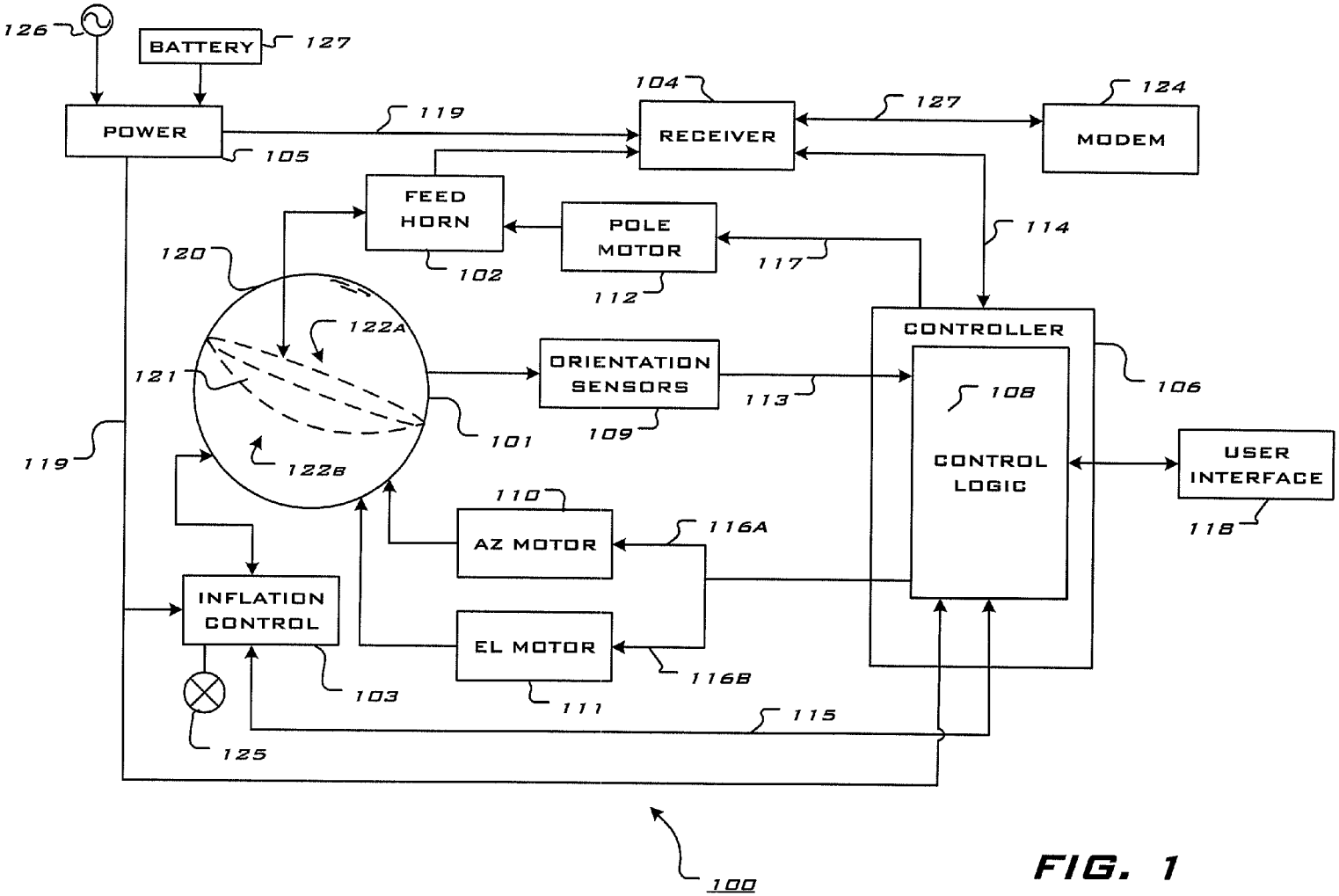
FIG. 1 is a functional schematic diagram of an exemplary automatically deployable communications system.

FIG. 1 presents a functional diagram of an exemplary operational architecture 100 for an automatically deployable inflatable antenna 101 which comprises a generally spherical body 120 that defines two plenum chambers 122*a*, 122*b*, and supports a flexible dish 121 that separates one chamber 122*a*, from the other 122*b*. A feed horn 102 is attached to an upward surface, generally at a pole, of the sphere 120, and is suitable for coupling electromagnetic signals from the dish 121 to a transceiver 104 for coupling signals from the transceiver 104 back to the dish 121 for transmission into a transmission medium. An inflation control subsystem 103 for supplying inflating air and for maintaining proper inflation pressure is coupled in fluid communication with the plenum chambers 122*a*, 122*b*. The system includes a motor for positioning the antenna 101, and thus the feed horn/dish in azimuth 110, and a motor for positioning the antenna 101 in elevation 111. Orientation sensors 109*a*, 109*b* suitable for measuring azimuth and elevation angles, as well as acceleration (preferably in three planes of motion) of the antenna 101 are provided and may be attached to the antenna 101 or to a mechanism for supporting the antenna 101 and are configured to generate signals 113 representing values of measured antenna 101 azimuth and elevation angles. In one embodiment, a pole motor 112 may be mechanically coupled to the feed horn 102 to provide motorized adjustment of the distance between the feed horn 102 and the dish 121.

A controller 106, which is preferably a computer-based controller, is configured with control logic 108 (described in greater detail below) and is responsive to the measured azimuth and elevation signals 113 received from the azimuth and elevation sensors 109. The controller 106 also receives input from the transceiver 104 representing signal strength of the received satellite signals 114. The controller 106 is configured to output control signals 116*a*, 116*b* to the azimuth and elevation drive motors 110, 111, respectively, based upon manual input from a user through the user interface 118 or automatically, using a tracking algorithm within the control logic 108 which is configured to automatically position the antenna optimally for transmission and receipt of electromagnetic signals with, for example, a satellite, based upon measured azimuth and elevation signals 113.

The inflation control subsystem 103 may be as embodied in co-owned U.S. Pat. No. 8,021,122, to Clayton, and comprise pressure sensors 125 for detecting pressure within the chambers 122*a*, 122*b*. Pressure sensor 125 measurements 115 are relayed by the inflation control subsystem 103 to the controller 106 where it is received as input by control logic 108 which is configured to output control signals for energizing and de-energizing the blower subsystem 103 in order to maintain proper pressures within each chamber 122*a*, 122*b*. In addition, controller 106 also issues control signals 117 to pole motor 112 to control adjustment of the feed horn 102 position relative to the dish 121 as mentioned above.

The system 100 also includes a power supply module 105 for providing power 119 to energize the various components. The power supply module 105 may be coupled to an energy storage device 125, e.g., a battery, or may be configured to be coupled to external power 126.

Figure 2:
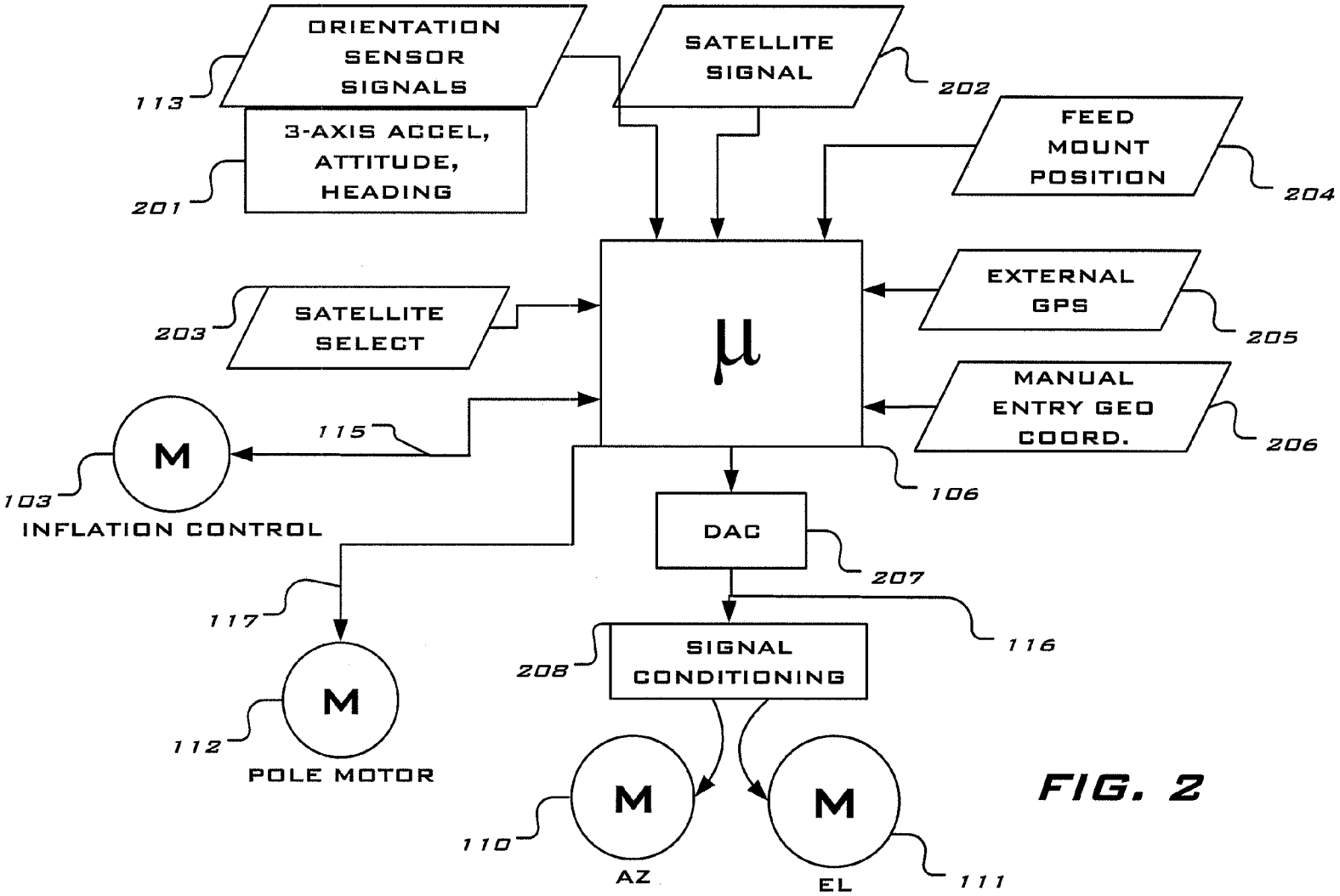
FIG. 2 is a functional schematic diagram of an exemplary controller that may be used in the embodiment shown in FIG. 1.

FIG. 2 is another functional schematic pertaining to the present embodiment and illustrating controller 106 and its various input data in greater detail. As described above, azimuth and elevation measurement signals 113 are received as input by the controller 106 and are processed for positioning and maintaining position of the antenna 101 with respect to a satellite. The orientation signals 113 preferably comprise, in addition to azimuth and elevation, three-axis acceleration measurements 201. The controller 106 also receives input from a sensor 204 that detects the feed horn 102 position that is used to automatically control the feed horn 102 position as described above. Data from an external GPS device 205, or, alternatively, manually entered geo-coordinates 206, along with identification of the desired satellite which the antenna is intended to track 203, is used by the controller 106 to determine proper antenna positioning relative to a desired satellite. The controller 106 also receives data from the satellite signal 202 which is also used by the positioning algorithm to determine whether the antenna 100 is optimally positioned and/or tracking the selected satellite.

In response to these inputs, and as may be directed by the algorithm executed by the control logic 108, the controller 106 issues energized command signals 116, 117, to the azimuth and elevation position motors 110, 111 or to the pole motor 112. Motors 110, 111, 112 are configured to actuate the antenna or the feed horn in two directions in their respective planes of motion. Some signal processing may be necessary with regard to control of the azimuth and elevation motors 110, 111. In one embodiment, motors 110, 111 require analog control signals 116 and thus, a digital-to-analog converter 207 may be required as well. It may also be advantageous in another embodiment to include a signal conditioner 208 to pre-process the analog signals prior to energizing the motors 110, 111.

Figure 3:
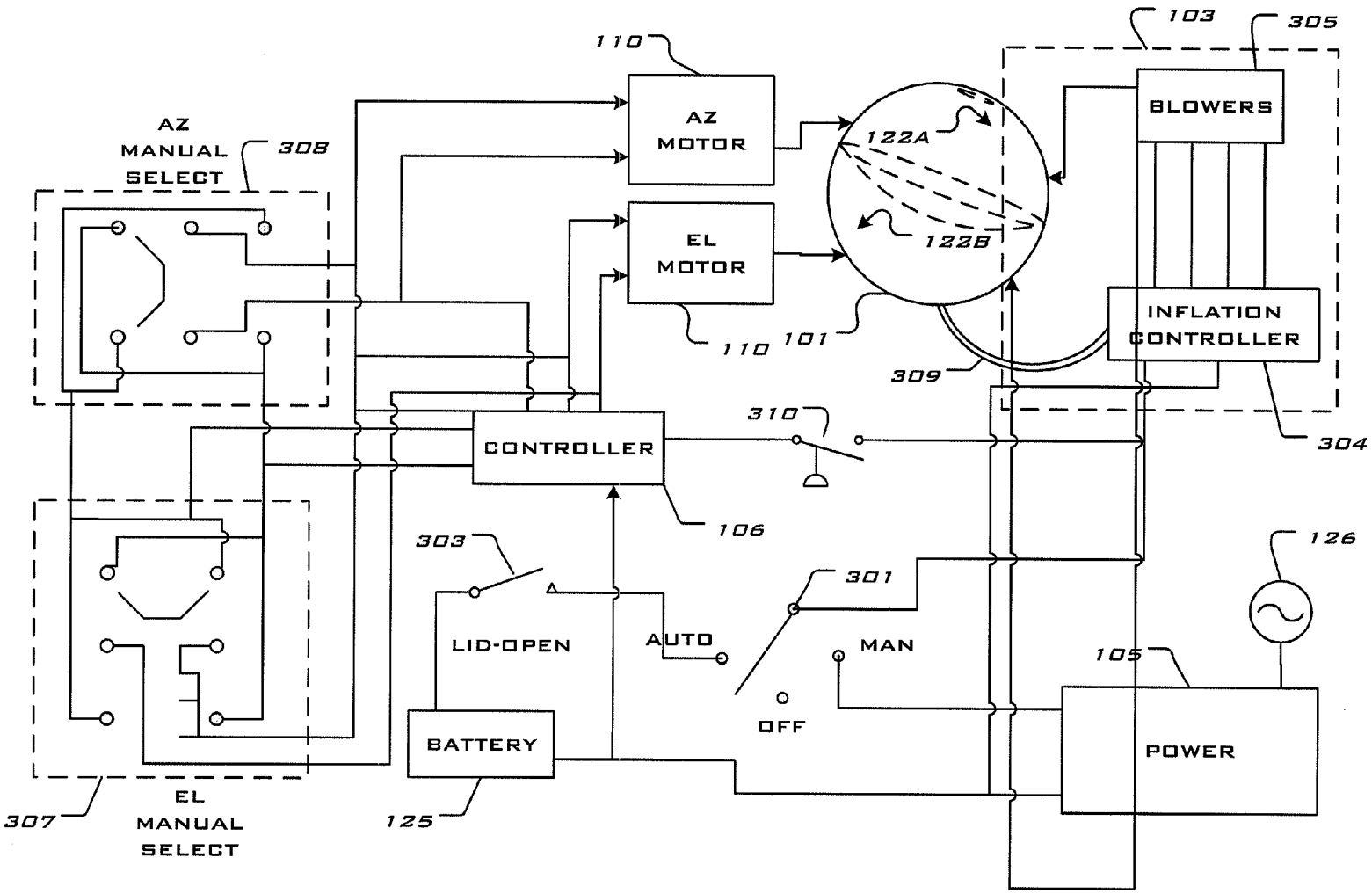
FIG. 3 is a schematic showing an exemplary electrical design for antenna orientation and inflation control of the system.

FIG. 3 is a schematic showing an exemplary electrical design for antenna orientation and inflation control of the system 100. A three-position power mode switch 301 allows switching between an auto mode, a manual mode and off. When auto mode is selected, a spring-biased switch 303 biased to the closed position is disposed intermediate the controller 106 and the power supply module 105 such that it is biased to complete the circuit. In addition, battery 125 may form part of the power circuit. Inflation control subsystem 103 in the illustrated embodiment comprises one or more blowers 305 in fluid communication with the plenum chambers 122*a*, 122*b* that are controlled by an inflation control module 304. Inflation control module 304 comprises pressure sensors which are configured to be in fluid communication with the interiors chambers 122*a*, 122*b*, illustrated in the schematic with air tubes 306 and includes a computer-based processor configured with control logic for selectively energizing the blowers based upon the measured pressures, e.g., if the controller 304 detects that the pressure in either chamber 122 is not sufficient, it engages the blower(s) 305 and shuts of the blowers 305 until the pressure is again within an acceptable operating range.

Azimuth and elevation motors 110, 111 are energized through the controller 106 as set out above. However, in one embodiment the system 100 may include manual switches for selecting azimuth and elevation 308, 307 respectively, which may also energize the motors 110, 111. In addition, the system 100 preferably includes a pressure switch 309 intermediate the controller 106 and the inflation control module 304.

Figure 5:
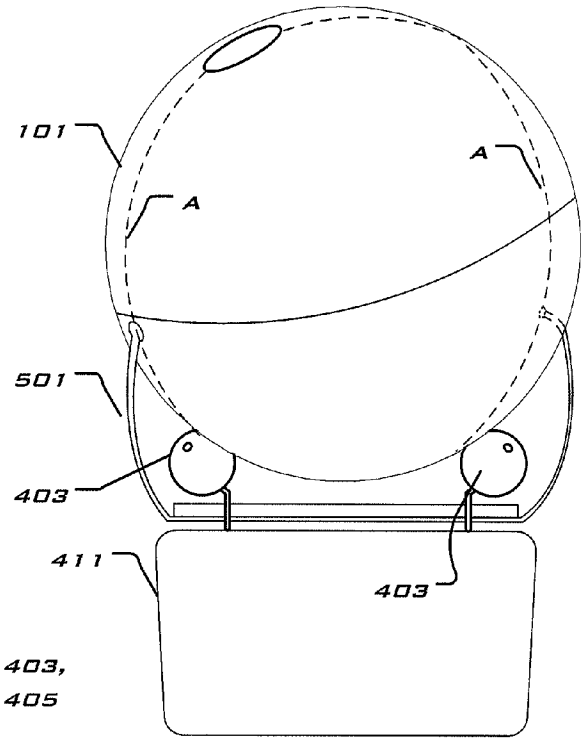
FIG. 5 is a second view of the embodiment shown in FIG. 4.
Figure 6:
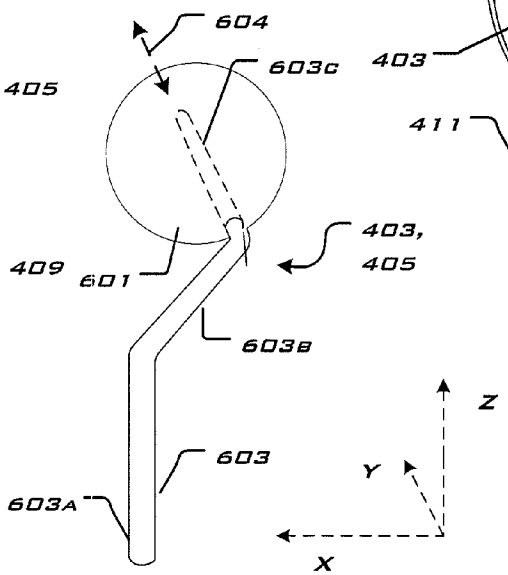
FIG. 6 is a detailed view of an exemplary antenna support member shown in FIGS. 4 & 5.
Figure 4:
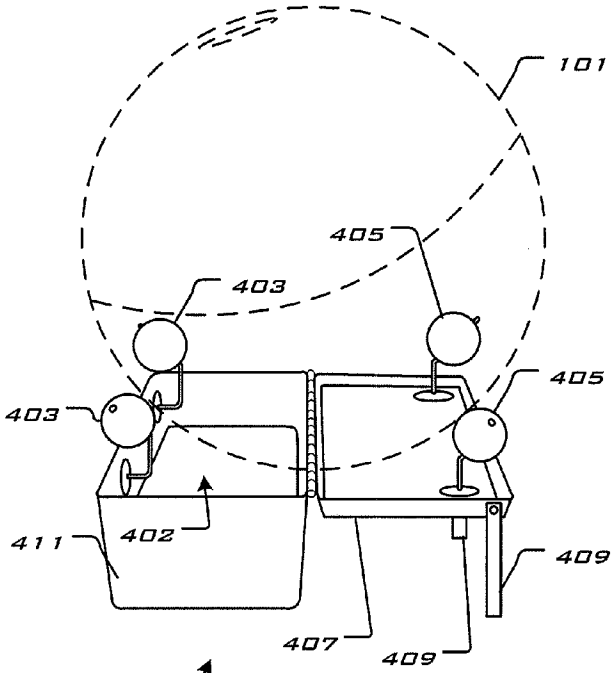
FIG. 4 depicts an exemplary automatically deployable communications system.
Figure 8:
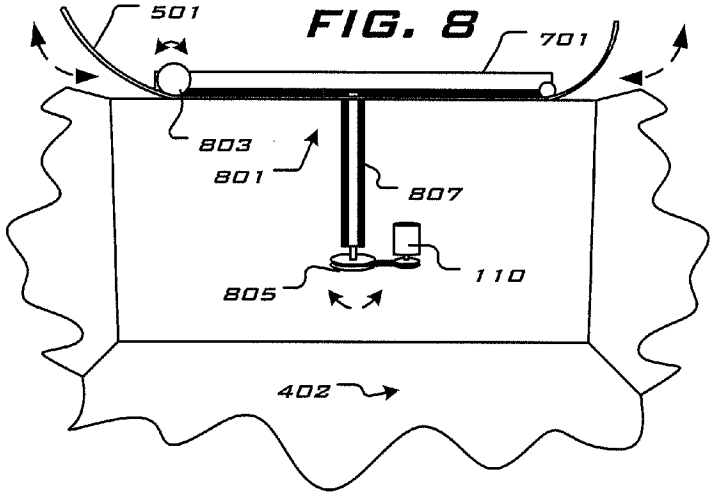
FIG. 8 is a cutaway view of the interior of the case.

FIGS. 4 & 5 depict a case 401 which defines a chamber 402 in which the non-inflated antenna 101 stored until deployment and inflation. The case 401 comprises a box 411 which defines a chamber 402 and a lid 407 that is hingedly attached to the box 411. Preferably, the case 401 may be dimensioned sufficiently large to house the system components described herein, but small enough to comply with standard requirements issued by airline carriers regarding the size of carry-on luggage.

Two antenna support members 403 are attached to the front inside wall of the box 411 and two antenna support members 405 are attached to the inside surface of the lid 407. Preferably, in the illustrated embodiment, the lid 407 further includes one or more supports 409 for keeping the lid 407 parallel to the horizontal plane, or more particularly, for keeping the support members 403, 405 all in the same horizontal plane so that the antenna 101 remains on a parallel plane with respect to the horizontal plane in order to provide an orientation reference for controlling position. In this embodiment, elevation and azimuth positioning is accomplished with a drive belt 501 having ends that are attached to the surface of the antenna 101 on either side of the lower hemisphere along a longitude line (dashed line A) of the 101 passing also through the location at which the feed horn 102 is mounted.

Antenna support members 403, 405 comprise a sphere 601 mounted through its axis 604 on an elongated rod 603 and allowed to revolve freely about the rod 603. The elongated rod 603 may include two bends 602, 606, each at about a 45° angle, dividing the rod into three portions 603*a*, 603*b*, 603*c*, the latter 603*c* departing the plane defined by the first two portions 603*a*, 603*b*, at about a 45° angle. As illustrated in FIG. 4, the antenna support members 403, 405 are mounted so that the axes 604 of the spheres 601 point away from the center of the case 401 at about a 45° angle, and inclined at about a 45° angle from the horizon.

Figure 9:
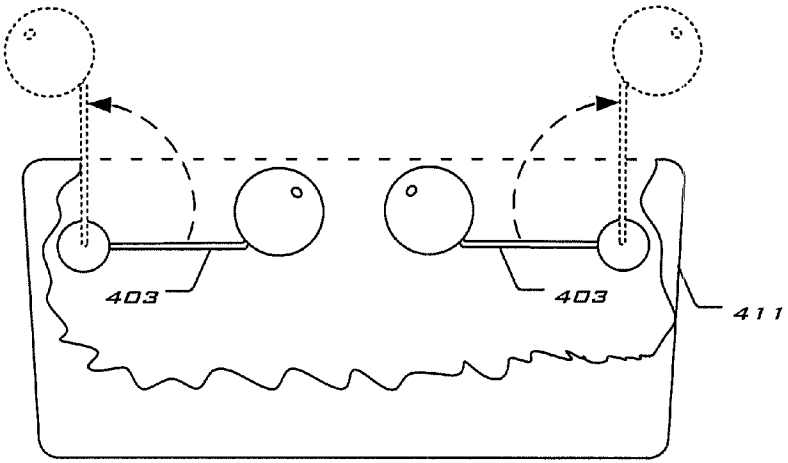
FIG. 9 is second cutaway view of the interior of the case illustrating the action of the antenna support members.
Figure 11:
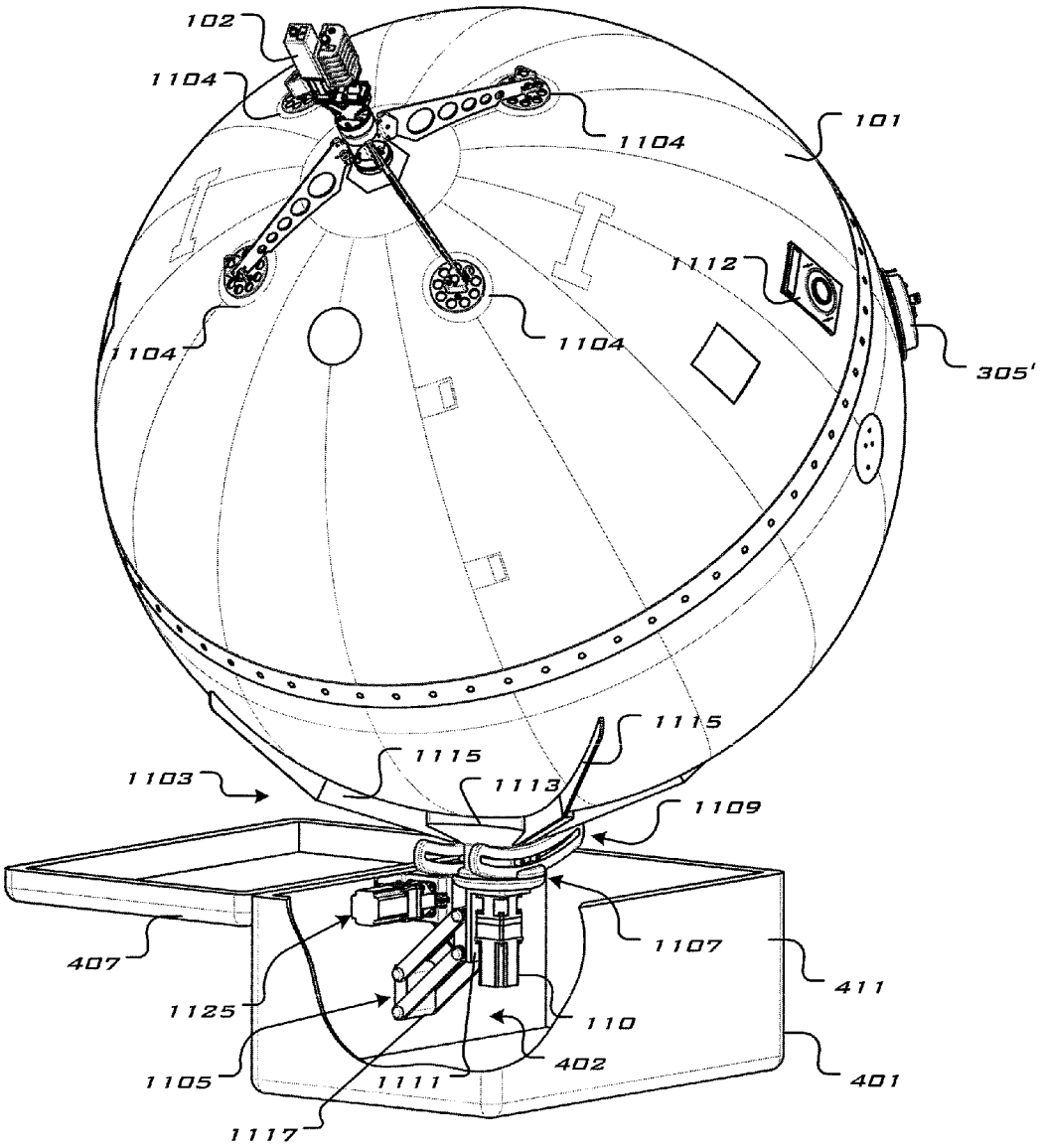
FIG. 11 depicts another embodiment of the automatically deployable communications system.
Figure 12:
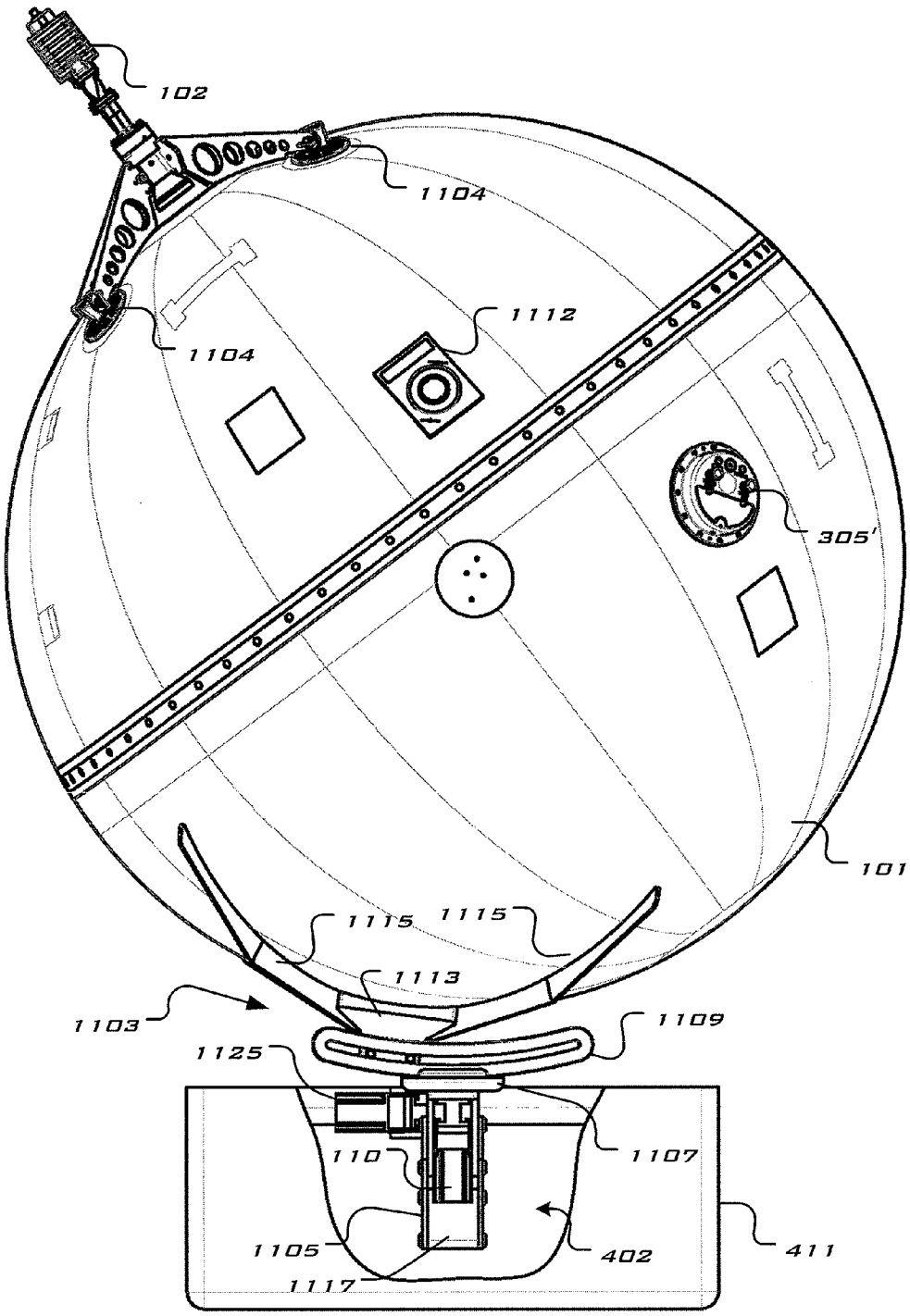
FIG. 12 is an elevation view of the embodiment of FIG. 11.
Figure 13:
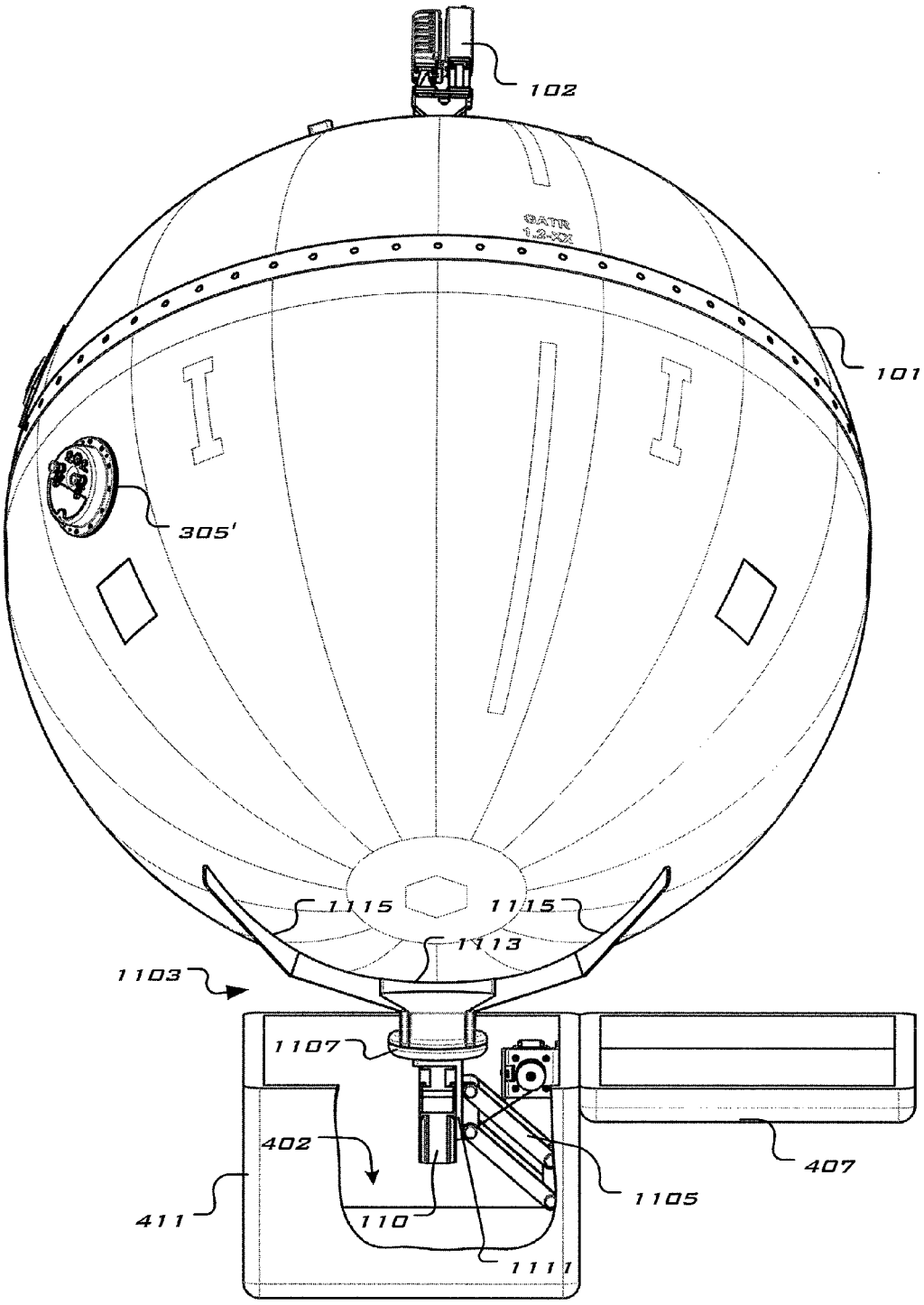
FIG. 13 is another elevation view of the embodiment of FIG. 11, rotated 90 degrees with respect to the view of FIG. 12.

FIGS. 7-10 show different views of the interior of the case 401 in the present embodiment, particularly illustrating antenna support members 403. As shown, antenna support members 403 are attached to the interior surface of the forward wall 702. Antenna support members 403 may be pivotally mounted with parallel stanchions 703 which allow support members 403 to pivot toward each other and down inside the box 411 so that the lid 407 may close and latch. Preferably, the pivoting attachment 703 is spring biased so that the support members 403 tend toward the vertical so that when the lid 407 is opened the support members 403 automatically pivot to the upright position (FIG. 9). The counterpart support members 405 may be fixedly attached to the inside surface of the lid 407 so that while they are upright when the lid is in the open position, when the lid 407 is closed, the members 405 are inserted into the box interior chamber 402.

Figure 10:
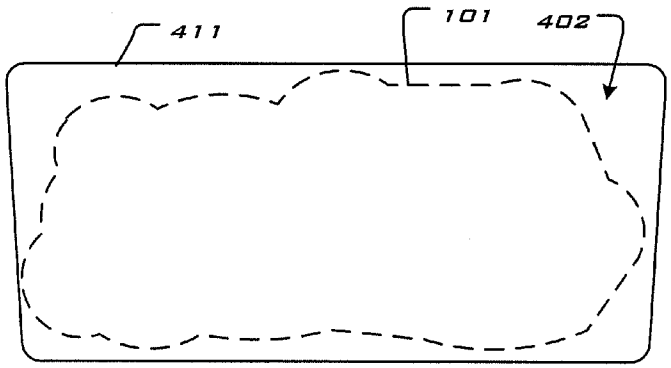
FIG. 10 depicts containment of the deflated antenna.
Figure 7:
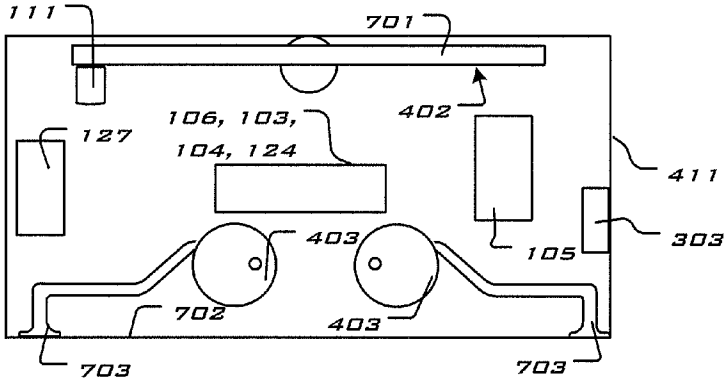
FIG. 7 is an overhead view of the interior of the case illustrated in FIG. 4.

The interior chamber 402 of the box 411 provides a housing for the control components of the system, namely, the power supply module 105, the controller 106, which may also include the receiver 104, modem 124, and the inflation control 103, the battery 127 and a spring return switch 303 that is mounted proximal to the top edge of the box 411 such that it closes the power circuit when the lid 407 is opened as described above, and remains open while the lid 407 is closed. The interior chamber 402 also contains the antenna 101 when it is non-inflated (FIG. 10).

The azimuth and elevation motors 110, 111 are employed in this embodiment with a t-bar 801. The elevation motor 111 is mounted to one end of the "T" 701 of the t-bar 801, and rotates a wheel 803 in the vertical plane and is configured to rotate the wheel 803 in either clockwise or counter-clockwise direction. The wheel 803 is engaged with the drive belt 501, so that rotation of the wheel 803 pulls the drive belt 501 in one direction or the other. A pulley 805 may be provided, mounted at the opposite end of the "T" 701 to insure the belt 501 remains engaged with the wheel 803. The upright portion 807 of the t-bar 801 is attached to a driven pulley 805 that lies in the horizontal plane, and is driven by the azimuth motor 110, likewise configured to rotate the pulley 805 in either a clockwise or counter-clockwise direction.

With reference again to FIG. 4, with the inflated antenna 101 resting on the freely revolving spheres 601 of the antenna support members 403, 405, azimuth and elevation positioning is achieved by energizing the azimuth motor 110 which rotates the t-bar 801 in either direction. Since the drive belt 501 is attached to the surface of the antenna 101 at its ends, and is attached to the t-bar through its engagement with the wheel 803, rotation of the t-bar in the azimuth plane, also rotates the antenna 101 in the same plane. On the other hand, energizing the elevation motor 111 rotates the wheel 803 pulling the drive belt 501, which, by virtue of its ends being attached to the surface of the antenna 101 along the same longitude line passing through the feed horn location A, the antenna 101 is rotated in the vertical plane.

In operation, the user selects either automatic deployment or manual deployment using the power mode switch 301 placed on the exterior of case 401. In automatic deployment mode, the spring switch 303 remains open until the lid 407 is opened whereupon the switch 303 closes the power circuit. Power supply circuit 105 provides power supplied from either battery 125 or from an external power source 126. Power is applied to the controller 106 and to the inflation control subsystem 103 where the inflation control module 304 energizes the blowers 305 to begin impelling air into the plenum chambers 122*a*, 122*b*. The inflation control module 304 samples the pressures within the chambers 122*a*, 122*b* through sensing tubes 309 and is configured with control logic, e.g., 108, which commands de-energizing of the blowers 305 when the proper pressures are reached. A pressure activated switch 310 may be used which is configured to maintain a closed circuit with the inflation control module 304 and to open when the proper pressure in the plenum chambers 122*a*, 122*b* is reached. The antenna 101 inflates and emerges from the box 411 and ultimately comes to rest on the upright antenna support members 403, 405, and specifically, upon the spheres 603 mounted thereon. Antenna positioning via the azimuth and elevation motors 110, 111 is conducted and the receiver 104 may then be coupled to a communications satellite selected by the user through the user interface 118.

With reference now to FIGS. 11 through 19, a further embodiment of the system 100 will be illustrated. Starting with FIGS. 11 through 13, the embodiment includes an inflatable antenna 101 supported by a case 401 comprising a lid 407 and a box 411 that defines a chamber 402 as described above. In the illustrated embodiment, the antenna 101 is secured to a base assembly 1103 mounted to base support flange 1111. An elevator assembly 1105 comprising in this embodiment two pairs of levers, each having one end pivotally attached to either side of the base support flange 1111 and opposing ends that are pivotally attached to a mounting bracket 1117 attached to the inside surface of the box 411. The base assembly 1103 comprises a turn table 1107 is mounted to the top surface of the base support flange 1111 and a pair of arcuate arms 1109 are mounted in parallel proximal to radially outward edges the turn table 1107. A pedestal 1113 is supported by the arcuate arms 1109 as shown in FIGS. 17A-C, where the arcuate arms 1109 are mounted to the turn table 1107 in parallel, and in this illustration, each includes an arcuate slot 1702. The pedestal 1113 is slidably engaged with the arcuate arms 1109 through pins 1701 extending from either side of the pedestal 1113 and through each arcuate slot 1702. The pins 1701 are free to travel in either direction in the slots 1702. Elevation drive motor 111 is housed within the pedestal 1113 and is coupled at least a pair of the pins 1701 such that they may be rotated in either direction by the motor 111. Thus, rotation of the pins 1701 within the slots 1702 rotates the antenna 101 in the elevation plane.

It will be appreciated by those skilled in the relevant arts with the benefit of this disclosure that the radius of the arc defined by the arcuate arms 1109 may be concentric with the center of the antenna. However, in order to achieve a greater range of motion in the elevation plane, the length of the arcuate arms may exceed the dimensions of the case. Consequently, to achieve a fuller range of motion it may be desirable to reduce the radius of curvature of the arms 1109 such that the center of the arc defined by the arms is below that of the antenna. Preferably, the radius of curvature of the arms is about half that of the antenna.

Returning to FIGS. 11 through 13, one embodiment of the antenna 101 comprises a surface-mounted, compact blower 305' having fluid communication with the chambers 122A, B, and controlled as described above. In another embodiment, an inclinometer 1112 for measuring elevation angle may also be mounted to the antenna surface.

An azimuth drive motor 110 is mounted to by base support flange 1111 and is coupled to the turn table 1107 to provide rotation of the turn table 1107 in the horizontal plane. An elevation drive motor 1125 is mounted to the inside surface of the box 411 and is coupled to a pulley 1126 with which is engaged a belt 1127 attached to the support flange 1111 such that rotation of the pulley 1126 in one direction pulls the belt 1127 causing the flange 1111, and thus, the base 1103, to elevate, supported by the flange's pivotal connection to the elevator assembly 1105 levers, whereas rotation of the pulley 1126 in the opposite direction lowers the flange 1111, and thus, the base 1103.

Figure 14:
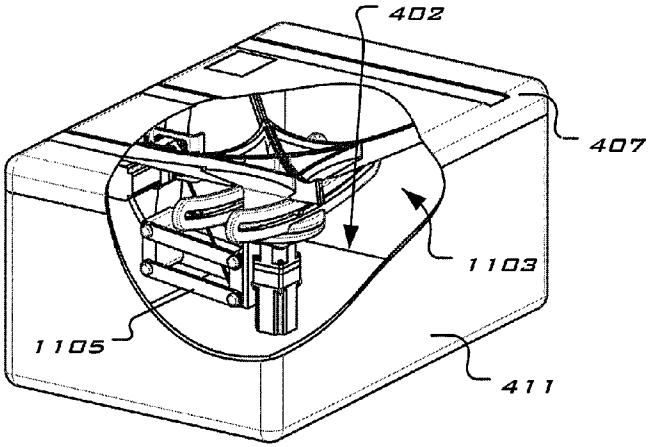
FIG. 14 is a cutaway view of the interior of the case showing the antenna base in a stowed configuration.
Figure 15:
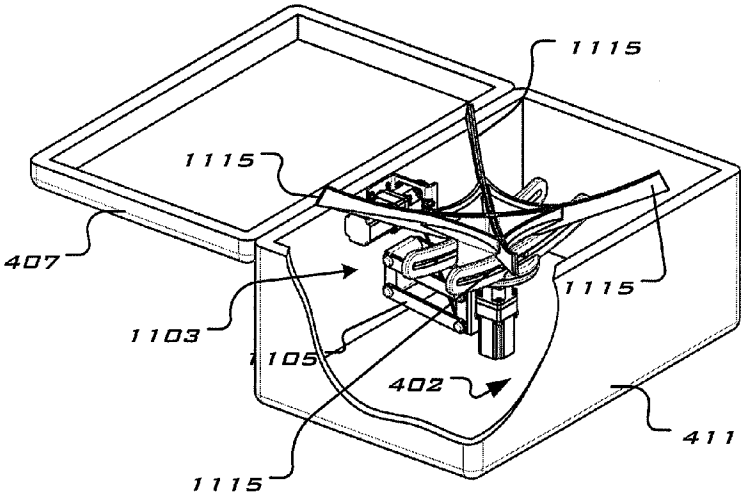
FIG. 15 illustrates the action of the base as begins to deploy.
Figure 16:
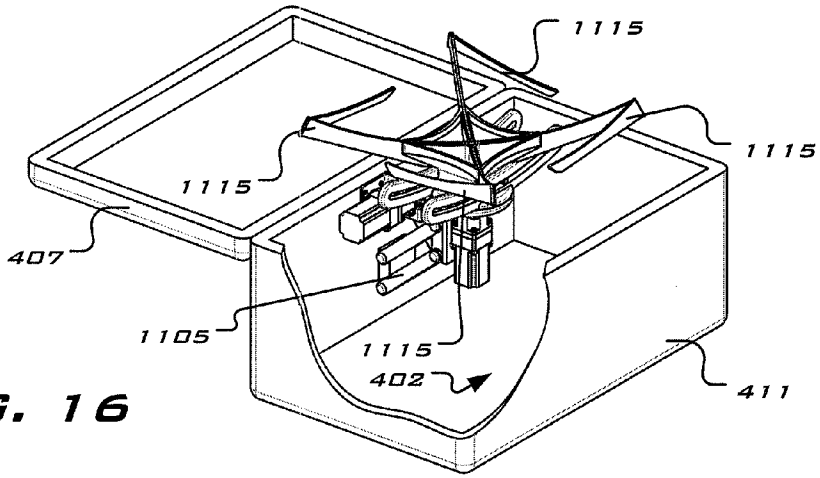
FIG. 16 illustrates the base in mid-deployment.
Figure 17B:
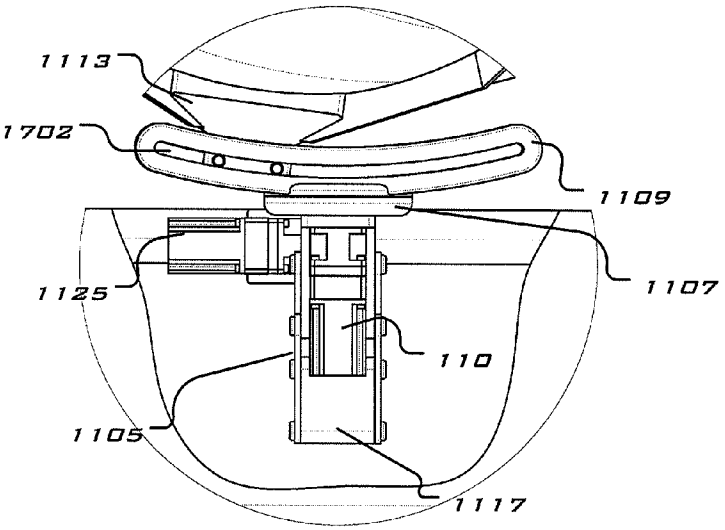
FIGS. 17A through 17C are detailed views of exemplary azimuth and elevation actuation structures of the embodiment illustrated in FIG. 11.
Figure 17A:
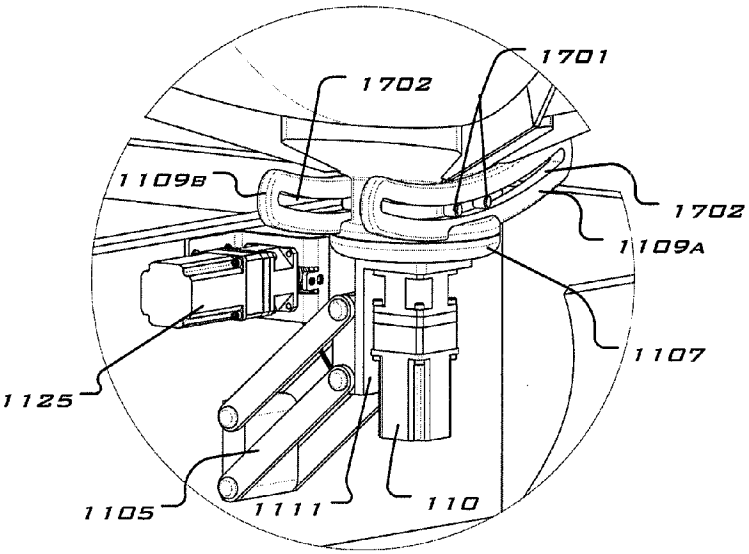
Figure 17C:
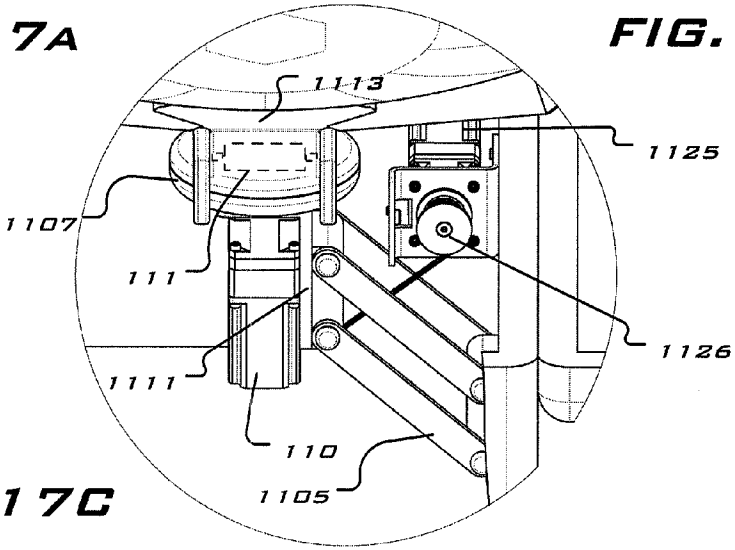

In this embodiment, the base 1103 also comprises a plurality of support arms 1115 that extend radially from the pedestal 1113 and whose radially outward ends are attached to the surface of the antenna 101 within the lower hemisphere, as shown. FIGS. 14 through 16 are perspective, cutaway views of the case 401 and are intended to generally illustrate the mechanics involved in deployment of the base 1103 with progressive stages of deployment. It will be understood that the antenna 101 is attached to the base 1103 at each of the support arms 1115 as described above. However, for clarity of illustration of the base mechanisms, the non-inflated antenna 101 is not shown. Starting with FIG. 14, base 1103 is housed within the chamber 402 with the lid 407 closed. Elevator assembly 1105 is completely retracted, positioned at its lowest point. FIG. 15, then, shows that when the lid 407 is opened, and elevator motor 1125 begins to actuate the elevator assembly 1105 as described above, raising the base 1103. In FIG. 16, it can be seen that support arms 1115 in the illustrated embodiment may comprise two hingedly coupled sections allowing the support arms 1115 to fold when in a stored, non-deployed status. But, by virtue of the attachment of the ends of the aims 1115 to the surface of the antenna 101, the support arms 1115 are extended as the antenna 101 inflates.

Figure 18A:
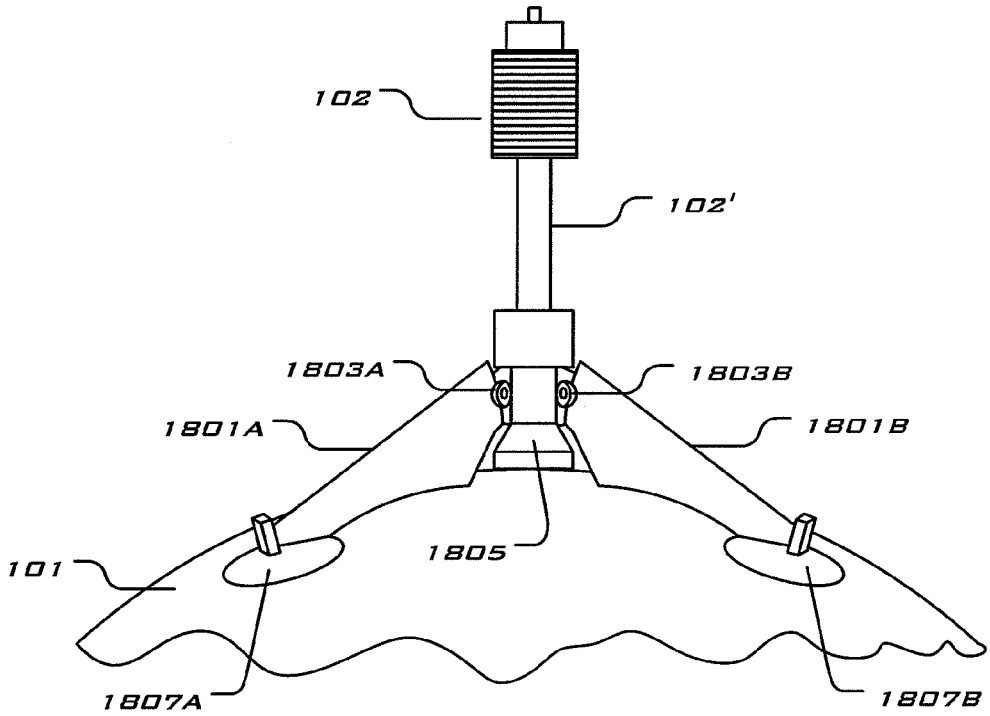
FIGS. 18A&B depict an exemplary collapsible feed horn for use with an automatically deployable communications system.
Figure 18B:
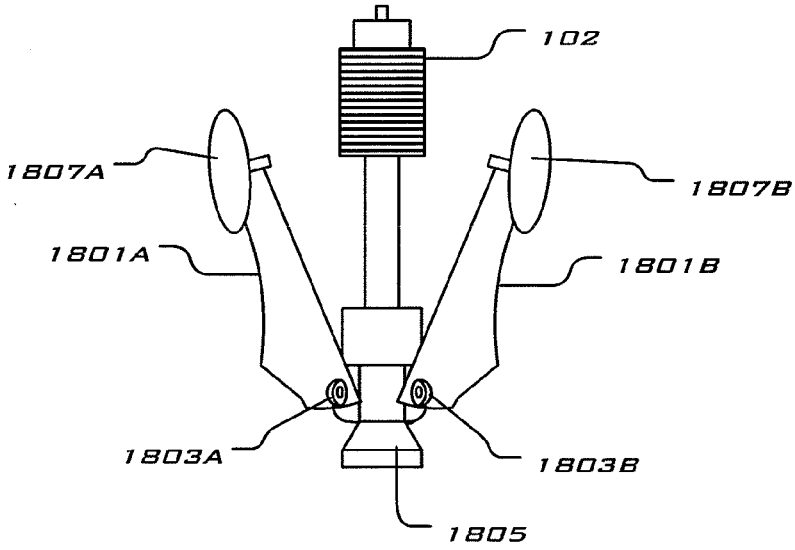

In addition, this embodiment includes a collapsible feed horn assembly 102 illustrated in FIGS. 18A & B. Feed horn assembly 102 comprises a feed horn 102' having a base 1805. A plurality of legs 1801A, B is pivotally attached at one end to the base 1805 with fasteners 1803A, B. The opposing ends 1807A, B of the legs 1801 are attached to the surface of the antenna 101. As the antenna 101 inflates, the legs 1801 extend to raise the feed horn 102' to position for operation (FIG. 18A). In FIG. 18B when the antenna 101 (not depicted for clarity of illustration) is deflated, the legs 1801 pivot vertically to decrease the space needed by the assembly 102 for storage in the case 401.

As described above and shown in the associated drawings, the present invention comprises an automatically deployable communications system. While particular embodiments of the apparatus have been described, it will be understood, however, that the invention represented by the disclosed apparatus is not limited thereto, since modifications may be made by those skilled in the art, particularly in light of the foregoing teachings. It is, therefore, contemplated by the appended claims to cover any such modifications that incorporate those features or those improvements that embody the spirit and scope of the invention claimed.

What is claimed is:

1. An automatically deployable, portable communications system comprising:

an inflatable antenna defining first and second plenum chambers separated by a flexible, lenticular dish;

a case having a lid and defining a chamber in which said antenna is stowed in a non-inflated state and which may be closed by said lid, said chamber comprising;

i. a support assembly mounted to an inside surface of said chamber for supporting said antenna;

ii. first and second motors for positioning said antenna in azimuth and elevation;

iii. an inflation control module for maintaining pressure within said first and second plenum chambers;

iv. a control system configured to send control signals to said first and second motors and said inflation control module;

v. a power supply module for supplying power to said control system, inflation control module and said first and second motors; and vi. a switch configured to close a circuit with said power supply module and initiate deployment and operation of said antenna when said lid is opened.

2. The communications system of claim 1, further comprising a feed horn attached to an exterior surface of said antenna.

3. The communications system of claim 2, wherein said feed horn comprises a plurality of legs, each of said plurality of legs having one end pivotally attached to a base of said feed horn, and a distal end attached to said antenna surface such that as said antenna deflates, said plurality of legs pivot vertically toward said feed horn.

4. The communications system of claim 1, wherein said support assembly further comprises:

a base assembly;

a plurality of levers coupled to said base assembly; and an elevator motor responsive to said control system and said power supply module configured to actuate said levers to raise and lower said base assembly.

5. The communications system of claim 4, further comprising:

a pedestal supported by said base assembly;

a plurality of support arms extending radially outward from said pedestal, each of said plurality of support arms having radially distal ends attached to said exterior surface of said antenna.

6. The communications system of claim 5, wherein each of said plurality of support arms comprises two or more sections coupled together with a hinged connection such that said support arms fold radially inwardly as said antenna deflates and unfold radially outwardly as said antenna inflates.

7. The communications system of claim 4, further comprising:

a horizontally oriented turn table rotated by said first motor and engaged with said pedestal.

8. The communications system of claim 7, further comprising:

one or more arcuate arms mounted to said turn table; and rolling pins extending from a lower portion of said pedestal rollingly engaged with said arcuate arms.

9. The communications system of claim 8, wherein said arcuate arms define a radius less than or equal to about half of a radius defined by said antenna.

10. The communications system of claim 1, wherein said support assembly comprises two support members mounted to an interior surface of said lid and two support members pivotally mounted to an interior front surface of said chamber and which are biased to pivot to an upright position when said lid is opened, said support members configured to provide support in four quadrants for said antenna such that said antenna may freely rotate in the horizontal and vertical planes.

11. The communications system of claim 10, wherein said support assembly comprises a positioning assembly for positioning said antenna in the horizontal and vertical planes, said positioning assembly comprising:

a t-bar having a cross member and an upright member, wherein said second motor is mounted to an end of said cross member and said upright member is rotatably driven by said first motor.

12. The communications system of claim 11, further comprising a belt engaged with said second motor and having first and second ends attached to either side of said antenna on a vertical plane defined through the axis thereof, such that operation of said second motor rotates said antenna in the vertical plane.

* * * * *